US006601563B2

(12) United States Patent
Funke et al.

(10) Patent No.: US 6,601,563 B2
(45) Date of Patent: Aug. 5, 2003

(54) EXHAUST GAS RE-CIRCULATION WITH A COMPRESSION RELEASE BRAKE ACTUATOR

(75) Inventors: Steven J. Funke, Princeville, IL (US); Scott A. Leman, Eureka, IL (US); Matthew G. Mickiewicz, Clayton, NC (US); Joshua C. Ruedin, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 18 days.

(21) Appl. No.: 10/028,848

(22) Filed: Dec. 20, 2001

(65) Prior Publication Data

US 2003/0116125 A1 Jun. 26, 2003

(51) Int. Cl.[7] ..... F02D 13/04; F02B 47/08
(52) U.S. Cl. ..... 123/321; 123/568.14
(58) Field of Search ..... 123/321, 322, 123/568.14

(56) References Cited

U.S. PATENT DOCUMENTS

| | | | | |
|---|---|---|---|---|
| 4,356,806 A | | 11/1982 | Freesh | |
| 4,426,986 A | | 1/1984 | Muller et al. | |
| 4,572,114 A | | 2/1986 | Sickler | |
| 4,700,684 A | | 10/1987 | Pischinger et al. | |
| 5,012,778 A | | 5/1991 | Pitzi | |
| 5,479,890 A | | 1/1996 | Hu et al. | |
| 5,483,927 A | | 1/1996 | Letang et al. | |
| 5,601,068 A | | 2/1997 | Nozaki | |
| 5,657,630 A | | 8/1997 | Kjemtrup et al. | |
| 5,709,191 A | | 1/1998 | Monnier | |
| 5,718,199 A | | 2/1998 | Hu et al. | |
| 5,787,859 A | | 8/1998 | Meistrick et al. | |
| 5,809,964 A | | 9/1998 | Meistrick et al. | |
| 5,832,880 A | | 11/1998 | Dickey | |
| 5,941,220 A | | 8/1999 | Kuhn | |
| 5,967,115 A | | 10/1999 | Konopka et al. | |
| 6,009,709 A | | 1/2000 | Bailey | |
| 6,012,424 A | | 1/2000 | Meistrick | |
| 6,170,474 B1 | | 1/2001 | Israel | |
| 6,354,254 B1 | * | 3/2002 | Usko | 123/568.14 |
| 6,439,195 B1 | * | 8/2002 | Warner | 123/321 |
| 6,510,824 B2 | * | 1/2003 | Vorih et al. | 123/321 |
| 2001/0027773 A1 | * | 10/2001 | Janak et al. | 123/321 |
| 2002/0023619 A1 | * | 2/2002 | Janak et al. | 123/321 |
| 2002/0056435 A1 | * | 5/2002 | Yang et al. | 123/321 |

* cited by examiner

*Primary Examiner*—Erick Solis
(74) *Attorney, Agent, or Firm*—Taylor & Aust. P.C.

(57) ABSTRACT

Exhaust gas re-circulation is achieved internally in an internal combustion engine having intake and exhaust valves actuated by a camshaft. A controller monitors at least one engine parameter and automatically actuates an electrically actuated fluid operated brake actuator at a predetermined timing of movement of an engine piston to cause the actuator to maintain the exhaust valve at an intermediate position between a full open position and a closed position of the exhaust valve and cause exhaust gasses to be delivered from the exhaust manifold to the combustion chamber of the engine.

24 Claims, 4 Drawing Sheets

EXHAUST GAS RE-CIRCULATION WITH A COMPRESSION RELEASE BRAKE ACTUATOR

TECHNICAL FIELD

This present invention relates to internal exhaust gas re-circulation and more particularly to a system for providing internal exhaust gas re-circulation with a compression release brake actuator.

BACKGROUND

Exhaust gas re-circulation systems have been utilized to control emissions and reduce undesirable gasses and particulate matter to the atmosphere. Such engines have been used in an assortment of applications, such as, on highway, off highway and other internal combustion engine powered mobile equipment.

Exhaust gas re-circulation systems (EGR) typically direct a portion of the exhaust gases emitted from an internal combustion engine to a combustion chamber of the engine by way of an EGR valve disposed in and elaborate external system of ducting and other components. The exhaust gas which is directed to the combustion chamber reduces the concentration of oxygen in the combustion chamber. This reduction in the concentration of oxygen lowers the maximum combustion temperature within the cylinder, slows the chemical reaction of the combustion process and decreases the formation of nitrous oxides (NOx).

Exhaust gasses also contain unburned hydrocarbons. By reintroducing a portion of the exhaust gasses to the combustion chamber the unburned hydrocarbons are subsequently burned. This further reduces the emission of exhaust gas by-products which would otherwise be emitted as undesirable pollutants from the internal combustion engine.

Internal combustion engines often include a turbocharger (s) to increase engine performance. Such devices utilize exhaust gases to drive a turbine disposed in the exhaust gas stream of the engine. The turbine is connected to and powers a compressor which boosts the pressure of air supplied to the inlet manifold of the engine. In turbocharged engines, the EGR valve directs a portion of the exhaust gases by way of the ducting from an exhaust manifold of the engine to an inlet of the compressor. This may result in the fouling of the turbocharger compressor and an intercooler of the engine, when such is provided.

U.S. Pat. No. 6,012,424 to Zdenek Meistrick, dated Jan. 11, 2000 discloses an apparatus to accomplish exhaust gas re-circulation and/or engine braking. This patent discloses an elaborate and complicated system of actuators, control valves and fluid pressure sources defining separate EGR and compression release operating circuits which communicate with and control a slave piston to actuate at least one exhaust valve. Since the operating circuits are dependent on one another to trigger compression release braking and EGR system flexibility is limited. For example, a full range of EGR may not be supplied to the engine.

This invention is directed at overcoming one or more of the problems set forth above.

SUMMARY OF THE INVENTION

In one embodiment, a compression release brake actuating system for achieving compression release braking and internal exhaust gas re-circulation in an internal combustion engine having a cylinder, a bore in the cylinder and a piston slidably disposed in the bore and movable relative to the cylinder between a top dead center position and a bottom dead center position. A cylinder head is connected to the cylinder and an exhaust manifold is connected to the cylinder head. A combustion chamber is defined by the cylinder head, piston and cylinder. An exhaust valve is connected to the cylinder head and movable between a closed position and an open position. The exhaust valve has substantially zero lift relative to the cylinder head at the closed position and a predetermined maximum amount of lift relative to the cylinder head at the open position. The exhaust valve is adapted to pass exhaust gas between the combustion chamber and the exhaust manifold at the open position and is adapted to block the passing of exhaust gas between the exhaust manifold and the combustion chamber at the closed position. An intake valve is connected to the cylinder head and is movable between a closed position and an open position, said intake valve having substantially zero lift relative to the cylinder head at the closed position and a predetermined maximum amount of lift relative to the cylinder head at the open position. The intake valve is adapted to pass intake fluid flow between said intake manifold and the combustion chamber at the open position of the intake valve and adapted to block the passing of intake fluid flow between the combustion chamber and the intake manifold at the closed position of the intake valve. A camshaft is operatively connected to move the intake and exhaust valves between the closed and open positions. The camshaft determines the maximum amount of lift of each of the exhaust and intake valves at the open position. The exhaust valve is movable to the open position during movement of the piston within a first predetermined range of piston movement and the intake valve is movable to the open position during movement of the piston within a second predetermined range of piston movement. A compression release brake actuator is operatively connected to the exhaust valve and actuatable to maintain the exhaust valve at an intermediate lift position having a magnitude between the maximum amount of lift and the closed position during a predetermined portion of at least one of the first and second ranges of piston movement and providing a re-circulation of the exhaust gas between the exhaust manifold and the combustion chamber.

In another embodiment, an internal combustion engine includes a cylinder having a bore and a piston slidably disposed in the cylinder bore and movable relative to the cylinder between a top dead center position and a bottom dead center position. A cylinder head is connected to the cylinder. An exhaust manifold is connected to the cylinder head. A combustion chamber is defined by the cylinder head, the piston and the cylinder. An exhaust valve is connected to the cylinder head and movable between a closed position and an open position. The exhaust valve has substantially zero lift relative to the cylinder head at the closed position and a predetermined maximum amount of lift relative to the cylinder head at the open position. The exhaust valve is adapted to pass exhaust gas between the combustion chamber and the exhaust manifold at the open position and adapted to block the passing of exhaust gas between the exhaust manifold at the closed position. An intake valve is connected to the cylinder head and movable between a closed position and an open position. The intake valve has substantially zero lift relative to the cylinder head at the closed position and has a predetermined maximum amount of lift relative to said cylinder head at the open position. The intake valve is adapted to pass intake fluid flow between the intake manifold and the combustion chamber at the open position of the intake valve and being adapted to block the passing of intake fluid flow between the combustion chamber and the intake manifold at the closed position of the intake valve. A camshaft is operatively connected to move the intake and exhaust valves between the closed and open positions. The camshaft determines the maximum amount of lift of each of the exhaust and intake valves at the open position. The exhaust valve is movable to the open position during movement of the piston within a first predetermined range of piston movement and the intake valve is movable to the open position during movement of the piston within a second predetermined range of piston movement. A compression release brake actuator is operatively connected to said exhaust valve and being actuatable during said first predetermined range of piston movement to modify the movement of the exhaust valve between said open and closed positions and maintain the exhaust valve at said intermediate position during at least a portion of the first range of piston movement and during a portion of a second range of piston movement and provide a re-circulation of the exhaust gas between the exhaust manifold and the combustion chamber.

In yet another embodiment, a method of controlling internal exhaust gas re-circulation in an internal combustion engine having a compression release brake actuator, an exhaust valve, an intake valve, an exhaust manifold, a cam shaft operatively connected to move said exhaust valve between an open position at which the exhaust valve is at a maximum lift position and a closed position, a combustion chamber defined by a piston, a cylinder and a cylinder head, The piston being movable between a top dead center position and a bottom dead center position, including the steps of: moving the exhaust valve mechanically with the camshaft from the closed position to the open position in response to the piston being at a first predetermined range of piston movement; moving the intake valve mechanically by the camshaft from the closed position to the open position in response to the piston being at a second predetermined range of piston movement different than said first predetermined range of piston movement; actuating the compression release brake actuator in response to the piston being at a predetermined position within at least one of the predetermined first and second predetermined ranges of piston movement; maintaining the exhaust valve at the intermediate lift position subsequent to actuation of the compression release brake actuator and during a predetermined range of piston movement; and passing exhaust gas between the exhaust manifold and the combustion chamber while the exhaust valve is at the intermediate position.

DETAILED DESCRIPTION

Figure 1:
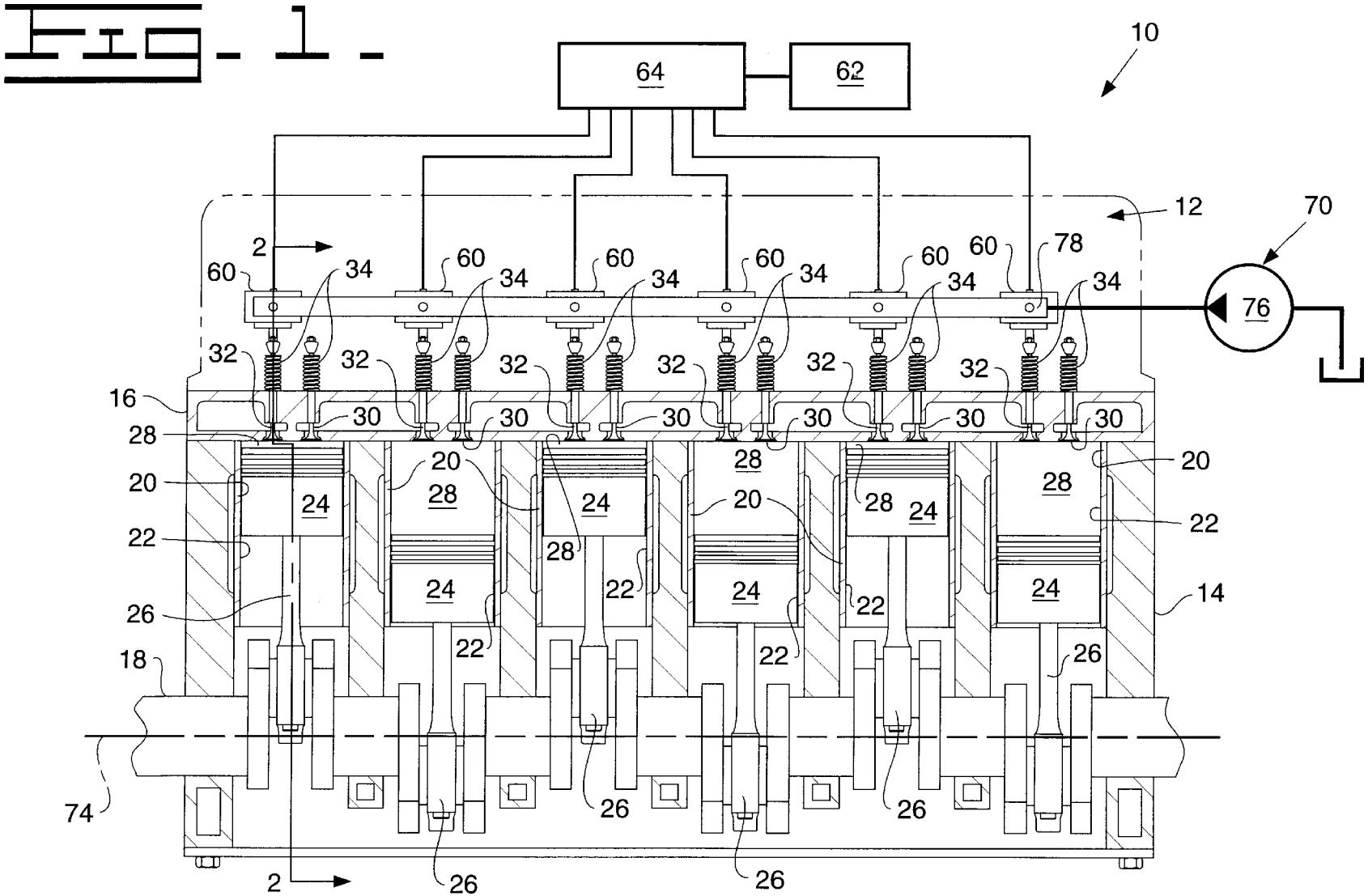
FIG. 1 is a diagrammatic longitudinal cross-section view of an embodiment of an internal combustion engine showing an engine brake and internal exhausts gas re-circulation system.
Figure 2:
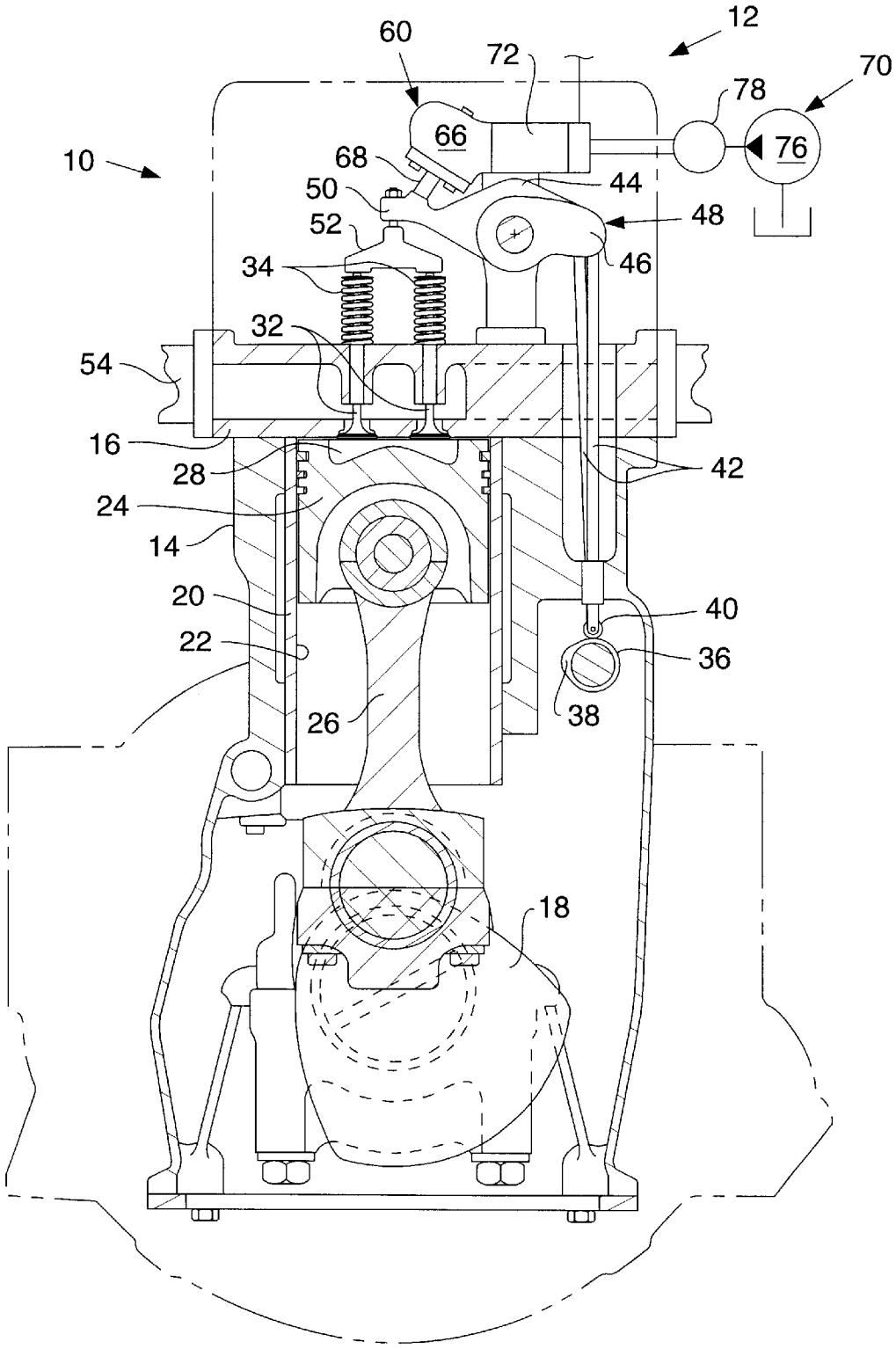
FIG. 2 is a diagrammatic cross-section view taken along line 2—2 of FIG. 1.

With reference to the drawings and particularly FIGS. 1 and 2, an internal combustion engine 10 is shown having with a compression release brake actuating system 12 for achieving compression release braking and internal exhaust gas re-circulation. The internal combustion engine 10 has an engine block 14, a cylinder head 16 connected to the engine block 14 by a plurality of fasteners (not shown), and a crankshaft 18 rotatively connected to the engine block 14. A plurality of cylinders 20, each having a bore 22, are disposed in the engine block 14 and connected to the cylinder head 16 by way of the aforementioned cylinder block connection. A plurality of pistons 24 are slidably disposed in the bore 22 of the cylinders 20, one in each cylinder 20, and connected to the crankshaft 18 by a connecting rod 26. The cylinder head 16 and each cylinder bore 22 and associated piston 24 define a combustion chamber 28 therebetween. The pistons 24 are movable in the cylinder bores 22 between a top dead center position (TDC) adjacent the cylinder head 16 and a bottom dead center position (BDC) spaced from the top dead center position as determined by the crankshaft 18. As shown in FIG. 1, the internal combustion engine is a 6 cylinder four cycle in line engine having combustion, exhaust, intake and compression strokes of the pistons 24. It is to be noted that internal combustion engines with a greater number of cylinders or a fewer number of cylinders are considered equivalents. It is also noted that the engine may operate in a two cycle mode.

Each cylinder 20 has a pair of intake valves 30 and a pair of exhaust valves 32. The intake and exhaust valves are 30, 32 are slidably connected to the cylinder head and moveable between a closed position at which the valves 30, 32 are in seated engagement and have substantially zero lift with respect to the cylinder head 16 and an open position at which the valves 30,32 are spaced a predetermined maximum desired lift distance from the seated position in the cylinder head 16. Each pair of intake and exhaust valves 30,32 are positioned in an associated combustion chamber 28. The intake and exhaust valves 30,32 are biased to the closed position by a coil spring 34 and mechanically opened into the combustion chamber 28 during normal engine operation by mechanical system 48 having a camshaft 36 rotatively connected to the engine block 14. The camshaft 36 is operatively connected to forcibly move the intake and exhaust valves 30,32 between the closed and open positions. The camshaft 36 determines the maximum amount of lift of each of the exhaust and intake valves 30,32 at the open position.

Figure 3:
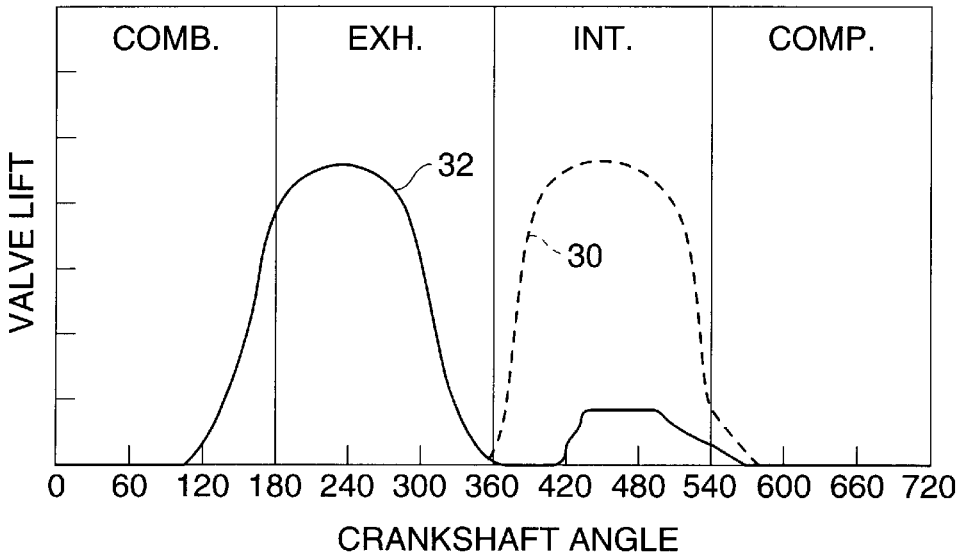
FIG. 3 is a graphical illustration of the timing and lift profiles of intake and exhaust valves of a 4 stroke internal combustion engine cycle with internal exhaust gas re-circulation.
Figure 4:
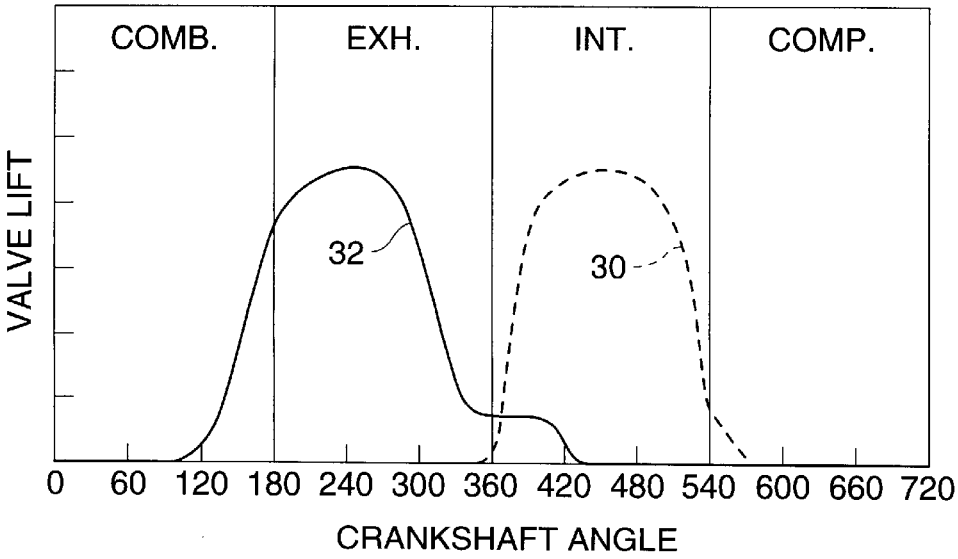
FIG. 4 is another graphical illustration of the timing and lift profiles of intake and exhaust valves of a 4 stroke internal combustion engine cycle with internal exhaust gas re-circulation.
Figure 5:
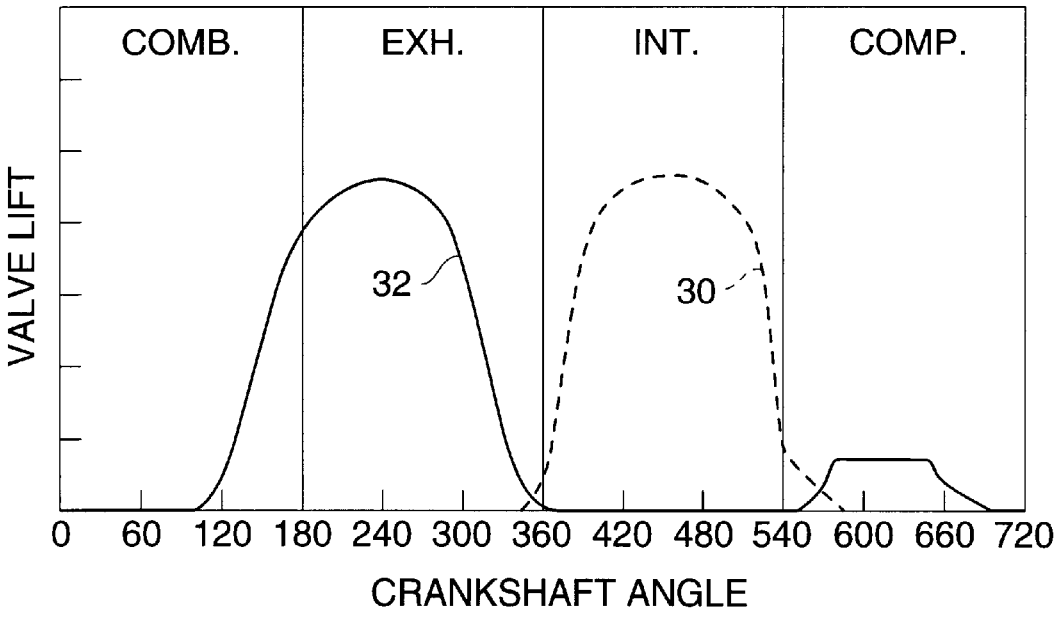
FIG. 5 is another graphical illustration of the timing and lift profiles of intake and exhaust valves of a 4 stroke internal combustion engine cycle with internal exhaust gas re-circulation.

As best seen in FIGS. 3–5, and with respect to each cylinder 20 of the internal combustion engine 10, the exhaust valves 32 are timed to normally be movable by the camshaft 36 to the open position during movement of the respective piston 24 within a first predetermined range of piston movement and the intake valves 30 are timed to normally be movable by the camshaft 36 to the open position during movement of the piston 24 within a second predetermined range of piston movement. As shown in FIGS. 3–5, the camshaft 36 begins opening the exhaust valve 32 on the combustion stroke of the respective piston 24 at about 90 degrees of rotation of the crankshaft 18 and normally closes the exhaust valve 32 on the exhaust stroke of the piston 24 at about 360 degrees of crankshaft rotation. The camshaft 36 begins opening the intake valve 30 on the at about 360 degrees of crankshaft 18 rotation and on the exhaust stroke of the piston 24 and closes the intake valve 30 on the compression stroke of the piston 24 at about 540 degrees of rotation of the crankshaft 18. It should be noted that the specific crankshaft angles recited are approximate and may vary for between engine platforms.

In the embodiment shown in FIG. 2, each lobe 38 of the camshaft 36 engages and reciprocally moves a cam follower 40. A push rod 42 transfers motion of the cam follower to a rocker arm 44 pivotally connected to the cylinder head 16. One end 46 of the rocker arm 44 bears against the push rod 42 and an opposite end 50 of the rocker arm bears against a valve bridge 52. The valve bridge 52 is engageable with the pair of exhaust valves 32 and a similar valve bridge (not shown) is engageable with the pair of intake valves 30. It should be noted that, the camshaft 36 of the mechanical system 48 may directly mechanically actuate the intake and exhaust valves 30,32, directly engage the valve bridge 52, or directly engage the rocker arm 44. It should that single or multiple intake and exhaust valves 30,32 may be provided for each combustion chamber 28.

The fixed geometry of the mechanical system 48 establishes the amount of lift of the intake and exhaust valves 30, 32 between the closed and open positions. In the particular embodiment of the internal combustion 10 shown, the normal amount of travel to place the exhaust valves at the open position is about 20 millimeters (0.78 inches). This provides desirable engine exhaust flow characteristics and proper engine operation of the particular. It should be recognized that the amount of lift is a function of engine geometry and may vary by engine model.

An exhaust manifold 54 is connected to said cylinder head and in fluid flow communication with the combustion chambers 28. The exhaust valves 32 are adapted to pass exhaust gas between each combustion chamber 28 and the exhaust manifold at the open position of the exhaust valve and adapted to block the passing of exhaust gas between said exhaust manifold 54 and the combustion chamber at the closed position of the exhaust valve.

An intake manifold 56 is connected to the cylinder head 16 and in fluid flow communication with each combustion chamber 28. The intake valve 30 passes intake fluid flow such as air and air/fuel mixture or other air mixture between the intake manifold 56 and the combustion chamber 28 at the open position and blocks the passing of intake fluid flow between the combustion chamber 28 and the intake manifold 56 at the closed position.

A turbocharger (not shown) of conventional design may be provided to boost the inlet air mixture pressure of the engine 10. The compressor of the turbocharger is connected to the intake manifold 56 and the turbine of the compressor is connected to the exhaust manifold 54.

The compression release brake actuating system 12 has at least one compression release brake actuator 60 which is connected to the cylinder head 16 of the internal combustion engine 10 and operatively connected to the exhaust valve 32 and actuatable to position the exhaust valve 32 at an intermediate lift position located between open position at which the maximum desired amount of lift is provided and the closed position during a predetermined portion of at least one of a first and second ranges of piston 24 movement and providing a re-circulation of the exhaust gas between said exhaust manifold 54 and the combustion chamber 28. It is to be noted that a compression release brake actuator 60 may be provided for one or more of the cylinders 20.

The compression release brake actuating system 12 has a sensor 62 adapted to sense an engine parameter and deliver a position signal related to a position of said piston 24. A controller 64 is connected to the compression release brake actuator 60 and to the sensor 62. The controller 64 may be a microprocessor based or discrete hard wired components. The controller 64 is adapted to receive the position signal and deliver a responsive actuation control signal. The compression release brake actuator 60 receives the actuation control signal and in one mode of operation moves the associated exhaust valve 32 to the intermediate lift position in response to receiving the actuation control signal. In another mode of operation, the compression release brake actuator 60 receives the actuation control signal and stops movement of the related exhaust valve 32 at the intermediate position in response to receiving the actuation control signal.

The sensor 62 may be adapted to sense the angular position of the crankshaft 18 as the crankshaft 18 rotates about its longitudinal axis 74 in the engine block 14. Since the crankshaft 18 is pivotally connected to the pistons 24, the angular position of the crankshaft 18 provides piston 24 position information. It should be noted that sensors 62 may include one or more sensors 62 and the sensor 62 may sense other engine parameters, for example, engine speed, cylinder pressure, and piston position to mention just a few.

The compression release brake actuator 60 has a body 66 connected to the cylinder head 16, a plunger 68 slidably movably connected to the body and movable between retracted and extended positions, and a source of pressurized fluid 70 connected to the plunger and adapted to move the plunger 68 relative to the body 66 to the extended position and stop movement of the exhaust valve 32 or position the exhaust valve 32 at the intermediate position. The plunger 68 may be engageable with the rocker arm 44 to maintain the exhaust valve 32 at the intermediate position.

The compression release brake actuator 60 has an electrically actuated control valve 72 having, for example, a solenoid, piezo or other known electrical actuator, controls the flow of pressurized fluid flow from the source of pressurized fluid 70 to the actuator 60. The electrically actuated control valve 72 is connected to the controller 64 and connected in fluid communication between the source of pressurized fluid flow 70 and the compression release brake actuator 60. The control valve 72 is actuatable to controllably deliver pressurized fluid flow to the actuator 60 in response to receiving the actuating control signal.

The source of pressurized fluid 70 may be a variable delivery pump 76 connected to a common rail 78 of a fuel system of the internal combustion engine 10. The variable delivery pump preferably delivers high pressure hydraulic actuating fluid, in the vicinity of 3000 psi, to the common rail. The high pressure hydraulic fluid provides the energy to actuate the fuel injectors (not shown). The common rail 78 is connected to the electrically actuated control valve 72 and provides pressurized fluid flow to also actuate the compression release brake actuators 60. It should be noted that other known sources of high pressure fluid are considered suitable substitutes.

As seen in FIG. 4, the compression release brake actuator 60 may be actuated during the first predetermined range of piston movement. This actuation modifies the movement of the exhaust valve 32 from the open to the closed position and maintains the exhaust valve 32 at the intermediate position during at least a portion of the second range of piston 24 movement to provide a late closing of the exhaust valve 32 and internal exhaust gas re-circulation. As seen in FIG. 4 the exhaust valve 32 closes at about 430 degrees of crankshaft 18 rotation.

As seen in FIG. 3, the second range of piston 24 movement occurs during an intake stroke of the piston 24. The compression release brake actuator 60 is actuated during movement of the piston 24 within the second range of piston 24 movement (intake stroke) and maintains the exhaust valve 32 at the intermediate position during a predetermined portion of the second range of piston 24 movement. Exhaust gas is re-circulated between the exhaust manifold 54 and the combustion chamber 28 during this predetermined portion of the second range of movement. As shown in FIG. 3, the exhaust valve 32 is moved to the intermediate position between of 420 degrees and about 560 degrees of camshaft rotation.

As seen in FIG. 5, each piston 24 is movable relative to the cylinder toward said top dead center position during a compression stroke of the piston 24. The compression release brake actuator 60 is actuatable during the compression stroke of the piston 24 and maintains the associated exhaust valves 32 at the intermediate position during a predetermined third range of movement of the piston 24 at which the pressure in the exhaust manifold 56 is greater in magnitude than the pressure in the associated combustion chamber 28 and exhaust gas is re-circulated from the exhaust manifold 56 to the combustion chamber 28.

INDUSTRIAL APPLICABILITY

With reference to the drawings and in operation the compression release brake actuating system 12, which is normally provided to move the exhaust valve 32 to the intermediate position when the piston 24 is near the top dead center position on the compression stroke of the piston 24 and blow down the related cylinder 20 to achieve compression release engine braking, also facilitates internal exhaust gas re-circulation between the exhaust manifold 54 and the combustion chamber 28 in a simple and economical manner by maintaining the exhaust valve 32 at the intermediate position at a proper timing relative to piston 24 position thereby eliminating the need for expensive external exhaust gas re-circulation systems or other complicated systems.

The compression release brake actuator 60 is actuatable in response to a signal delivered from the controller 64 which is related to an engine parameter signal delivered to the controller 64 based on the position of the piston 24. This facilitates accurate exhaust valve 32 response and precise exhaust valve positioning. Thus, the exhaust valve 32 is moved to the open and closed positions by way of the compression release brake actuator 60 in accordance with the timing set forth in FIGS. 3–5 and without requiring a substantial amount of additional hardware. The compression release brake actuating system 12 utilizes pressurized fluid flow from the high pressure source 70, which may have preexisted to provide pressurized hydraulic fluid flow for actuation of the fuel injectors (not shown), to force the plunger 68 of the actuator 60 to either maintain the exhaust valve 24 at the intermediate position or to forcibly urge the exhaust valve 24 to the intermediate position.

The actuator 60 receives an electrical signal from the controller 64 and the electrically actuated control valve 72 responds to this signal and delivers high pressure fluid from the high pressure source 70 to the plunger 68. The high pressure plunger 68 slidably extends from the body 66 which results in the exhaust valve 32 being maintained at the intermediate position. In the absence of a electrical control signal being delivered to the compression release brake actuator 60 the high pressure at the control valve 72 is blocked from the plunger 68 and the actuator is disabled.

The method of controlling internal exhaust gas re-circulation in an internal combustion engine 10 with the compression release brake actuator 60, comprises the steps of moving the exhaust valve 32 mechanically by the camshaft from the closed position to the open position in response to the piston being at a first predetermined range of piston 24 movement; moving the intake valve 30 mechanically by the camshaft 36 from the closed position to the open position in response to the piston 24 being at a second predetermined range of piston movement different than said first predetermined range of piston movement; and actuating the compression release brake actuator 60 in response to the piston 24 being at a predetermined position within at least one of said predetermined first and second ranges of piston 24 movement; maintaining the exhaust valve 32 at the intermediate lift position subsequent to actuation of the compression release brake actuator 60 and during a predetermined range of piston 24 movement; and passing exhaust gas between the exhaust manifold 54 and the combustion chamber 28 while the exhaust valve 32 is at the intermediate position.

The method further may include the steps of: maintaining the exhaust valve 32 at the intermediate position during a predetermined range of piston 24 movement occurring during the second predetermined range of piston 24 movement and during movement of the intake valve 30 between the open and closed positions.

The method may further include the steps of: stopping movement of the exhaust valve 32 at the intermediate position and from closing and maintaining the exhaust valve 32 at the intermediate position during a predetermined range of piston 24 movement during which the intake valve 30 is being moved between the closed and open positions.

The method further may include the steps of: moving the exhaust valve 32 to the intermediate position during the compression stroke of the piston 24, and maintaining the exhaust valve 32 at the intermediate position during a predetermined range of movement of the piston 24 during the compression stroke.

The method further may include the step of delivering a piston position signal to the compression release brake actuator 60 and moving the plunger 68 to a second position at which said exhaust valve 32 is maintained at the intermediate position.

Other aspects may be obtained from a study of the drawings, the disclosure and the appended claims.

What is claimed is:

1. A compression release brake actuating system for achieving compression release braking and internal exhaust gas re-circulation in an internal combustion engine, comprising:

a cylinder having a bore;

a piston slidably disposed in said cylinder bore and movable relative to said cylinder between a top dead center position and a bottom dead center position;

a cylinder head connected to said cylinder;

an exhaust manifold connected to said cylinder head;

a combustion chamber defined by said cylinder head, said piston and said cylinder;

an exhaust valve connected to said cylinder head and being movable between a closed position and an open position, said exhaust valve having substantially zero lift relative to the cylinder head at the closed position and having a predetermined maximum amount of lift relative to said cylinder head at the open position, said exhaust valve being adapted to pass exhaust gas between said combustion chamber and said exhaust manifold at the open position and being adapted to block the passing of exhaust gas between said exhaust manifold and said combustion chamber at the closed position;

an intake valve being connected to the cylinder head and being movable between a closed position and an open position, said intake valve having substantially zero lift relative to the cylinder head at the closed position and having a predetermined maximum amount of lift relative to said cylinder head at the open position, said intake valve being adapted to pass intake fluid flow between said intake manifold and said combustion chamber at the open position of the intake valve and being adapted to block the passing of intake fluid flow between the combustion chamber and the intake manifold at the closed position of the intake valve;

a camshaft being operatively connected to move the intake and exhaust valves between the closed and open positions, said camshaft determining the maximum amount of lift of each of the exhaust and intake valves at the open position, said exhaust valve being movable to the open position during movement of the piston within a first predetermined range of piston movement and said intake valve being movable to the open position during movement of the piston within a second predetermined range of piston movement; and a compression release brake actuator being operatively connected to said exhaust valve and being actuatable to position the exhaust valve at an intermediate lift position located between said maximum amount of lift and said closed position during a predetermined portion of at least one of the first and second ranges of piston movement and providing a re-circulation of the exhaust gas between said exhaust manifold and said combustion chamber.

2. The compression release brake actuating system, as set forth in claim 1, wherein said first range of movement being during an exhaust stroke of said piston, said compression release brake actuator being actuatable during said first predetermined range of piston movement to modify said movement of the exhaust valve between said open and closed positions and maintain the exhaust valve at said intermediate position during at least a portion of said second range of piston movement.

3. The compression release brake actuating system, as set forth in claim 2, including;

a sensor adapted to sense an engine parameter and deliver a position signal related to a position of said piston;

a controller being connected to said compression release actuator and to said sensor, said controller being adapted to receive said position signal and deliver a responsive actuation control signal; and said compression release actuator receiving said actuation control signal and stopping movement of the exhaust valve at said intermediate position in response to receiving said actuation control signal.

4. The compression release brake actuating system, as set forth in claim 3, wherein said compression release brake actuator including:

a body connected to the cylinder head;

a plunger slidably movably connected to the body between retracted and extended positions; and a source of pressurized fluid connected to move said plunger relative to said body to the extended position and stopping movement of the exhaust valve at the intermediate position.

5. The compression release brake actuating system, as set forth in claim 4, including a electrically actuated control valve connected to said compression release brake actuator and being adapted to control the flow of pressurized fluid flow from said source of pressurized fluid flow to said compression release brake actuator, said electrically actuated control valve being connected to said controller and adapted to deliver pressurized fluid flow to said compression release brake actuator in response to receiving said actuating control signal.

6. The compression release brake actuating system, as set forth in claim 5, wherein said source of pressurized fluid including:

a variable delivery pump; and a common fluid rail connected to the variable delivery pump and to the electrically actuated control valve.

7. The compression release brake actuating system, as set forth in claim 5, including a rocker arm pivotally connected to said cylinder head and engageable with said exhaust valve, said plunger being engageable with the rocker arm and maintaining the exhaust valve at the intermediate position.

8. The compression release brake actuating system, as set forth in claim 7, wherein said camshaft being rotatable to forcibly pivotally move said rocker arm and urge movement of the exhaust valve between the closed and open positions.

9. The compression release brake actuating system, as set forth in claim 4, including a crank shaft pivotally connected to said piston, said crank shaft being rotatable about a longitudinal axis and said sensor being adapted to sense the angular position of the crank shaft.

10. The compression release brake actuating system, as set forth in claim 2, wherein said second range of movement being during an intake stroke of said piston, said compression release brake actuator being actuated during movement of the piston within the second range of piston movement and maintaining the exhaust valve at the intermediate position during a predetermined portion of the second range of piston movement, said exhaust gas being re-circulated between the exhaust manifold and the combustion chamber.

11. The compression release brake actuating system, as set forth in claim 10, including;

a sensor adapted to sense an engine parameter and deliver a position signal related to a position of said piston;

a controller being connected to said compression release actuator and to said sensor, said controller being adapted to receive said position signal and deliver a responsive actuation control signal;

said compression release brake actuator receiving said actuation control signal and moving said exhaust valve to the intermediate position in response to receiving said actuation control signal.

12. The compression release brake actuating system, as set forth in claim 11, wherein said compression release actuator including:

a body connected to the cylinder head;

a plunger slidably movably connected to the body between retracted and extended positions; and a source of pressurized fluid connected to move said plunger relative to said body to the extended position and moving the exhaust valve to the intermediate position.

13. The compression release brake actuating system, as set forth in claim 12, including a rocker arm pivotally connected to said cylinder head and engageable with said exhaust valve, said plunger being engageable with the rocker arm and maintaining the exhaust valve at the intermediate position.

14. The compression release brake actuating system, as set forth in claim 13, wherein said camshaft being rotatable to forcibly pivotally move said rocker arm and urge movement of the exhaust valve between the closed and open positions.

15. The compression release brake actuating system, as set forth in claim 11, including a crank shaft pivotally connected to said piston, said crank shaft being rotatable about a longitudinal axis and said sensor being adapted to sense the angular position of the crankshaft.

16. The compression release brake actuating system, as set forth in claim 2, wherein said piston being movable relative to said cylinder toward said top dead center position during a compression stroke, said compression release brake actuator being actuatable during the compression stroke of the piston and maintaining said exhaust valve at the intermediate position during a predetermined third range of movement of the piston at which the pressure in the exhaust manifold is greater in magnitude than the pressure in the combustion chamber and exhaust gas is re-circulated from the exhaust manifold to the combustion chamber.

17. An internal combustion engine, comprising:

a cylinder having a bore;

a piston slidably disposed in said cylinder bore and movable relative to said cylinder between a top dead center position and a bottom dead center position;

a cylinder head connected to said cylinder;

an exhaust manifold connected to said cylinder head;

a combustion chamber defined by said cylinder head, said piston and said cylinder;

an exhaust valve connected to said cylinder head and being movable between a closed position and an open position, said exhaust valve having substantially zero lift relative to the cylinder head at the closed position and having a predetermined maximum amount of lift relative to said cylinder head at the open position, said exhaust valve being adapted to pass exhaust gas between said combustion chamber and said exhaust manifold at the open position and being adapted to block the passing of exhaust gas between said exhaust manifold and said combustion chamber at the closed position;

an intake valve being connected to the cylinder head and being movable between a closed position and an open position, said intake valve having substantially zero lift relative to the cylinder head at the closed position and having a predetermined maximum amount of lift relative to said cylinder head at the open position, said intake valve being adapted to pass intake fluid flow between said intake manifold and said combustion chamber at the open position of the intake valve and being adapted to block the passing of intake fluid flow between the combustion chamber and the intake manifold at the closed position of the intake valve;

a camshaft being operatively connected to move the intake and exhaust valves between the closed and open positions, said camshaft determining the maximum amount of lift of each of the exhaust and intake valves at the open position, said exhaust valve being movable to the open position during movement of the piston within a first predetermined range of piston movement and said intake valve being movable to the open position during movement of the piston within a second predetermined range of piston movement; and a compression release brake actuator being operatively connected to said exhaust valve and being actuatable during said first predetermined range of piston movement to modify said movement of the exhaust valve between said open and closed positions and maintain the exhaust valve at said intermediate position during at least a portion of said first range of piston movement and a second range of piston movement and provide a re-circulation of the exhaust gas between said exhaust manifold and said combustion chamber.

18. The internal combustion engine, as set forth in claim 17, wherein said compression release brake actuator being actuatable during the second predetermined range of piston movement and while the intake valve is at the first position, said compression release brake actuator maintaining the exhaust valve at the intermediate position during at least a portion of said second range of piston movement and provide a re-circulation of the exhaust gas between said exhaust manifold and said combustion chamber.

19. The internal combustion engine, as set forth in claim 18, wherein said piston being movable relative to said cylinder toward said top dead center position during a compression stroke, said compression release brake actuator being actuatable during the compression stroke of the piston and maintaining said exhaust valve at the intermediate position during a predetermined third range of movement of the piston at which the pressure in the exhaust manifold is greater in magnitude than the pressure in the combustion chamber and exhaust gas is re-circulated from the exhaust manifold to the combustion chamber.

20. A method of controlling internal exhaust gas re-circulation in an internal combustion engine having a compression release brake actuator, an exhaust valve, an intake valve, an exhaust manifold, a camshaft operatively connected to move said exhaust valve between an open position at which said exhaust valve is at a maximum lift position and a closed position, a combustion chamber defined by a piston, a cylinder and a cylinder head, said piston being movable between a top dead center position and a bottom dead center position; comprising the steps of:

moving the exhaust valve mechanically with the camshaft from the closed position to the open position in response to the piston being at a first predetermined range of piston movement;

moving the intake valve mechanically by the camshaft from the closed position to the open position in response to the piston being at a second predetermined range of piston movement different than said first predetermined range of piston movement;

actuating the compression release brake actuator in response to the piston being at a predetermined position within at least one of said predetermined first and second predetermined ranges of piston movement;

maintaining the exhaust valve at the intermediate lift position subsequent to actuation of the compression release brake actuator and during a predetermined range of piston movement; and passing exhaust gas between the exhaust manifold and the combustion chamber while the exhaust valve is at the intermediate position.

21. The method, as set forth in claim 20, including the steps of:

maintaining the exhaust valve at the intermediate position during a predetermined range of piston movement occurring during the second predetermined range of piston movement and during movement of the intake valve between the open and closed positions.

22. The method, as set forth in claim 21, including the steps of:

stopping movement of the exhaust valve at the intermediate position and from closing; and maintaining the exhaust valve at the intermediate position during a predetermined range of piston movement during which the intake valve is being moved between the closed and open positions.

23. The method as set forth in claim 20, including the steps of:

moving the exhaust valve to the intermediate position during a compression stroke of the piston; and maintaining the exhaust valve at the intermediate position during a predetermined range of movement of the piston during said compression stroke.

24. The method as set forth in claim 20, further including the step of:

delivering a piston position signal to the compression release brake actuator; and moving a plunger to a second position at which said exhaust valve is maintained at the intermediate position.

* * * * *